US005137506A

United States Patent [19]

Haenel et al.

[11] Patent Number: 5,137,506

[45] Date of Patent: Aug. 11, 1992

[54] IN-LINE FOLDER/GLUER

[75] Inventors: Max K. Haenel, Centerville; Gary N. Kilmer, Medway, both of Ohio

[73] Assignee: The Standard Register Company, Dayton, Ohio

[21] Appl. No.: 610,838

[22] Filed: Nov. 2, 1990

[51] Int. Cl.[5] ..... B65H 35/10; B65H 37/06

[52] U.S. Cl. ..... 493/417; 493/13; 493/27; 493/320; 493/416; 270/20.1; 271/184; 271/225; 271/259

[58] Field of Search ..... 493/10, 12, 13, 14, 493/15, 27, 188, 243, 249, 320, 405, 416, 417; 271/258, 259, 12, 13, 225, 184, 185; 270/20.1, 56

[56] References Cited

U.S. PATENT DOCUMENTS

| | | | |
|---|---|---|---|
| 2,147,541 | 2/1939 | Oberender . | |
| 2,504,948 | 4/1950 | Ferguson | 271/225 X |
| 2,506,550 | 5/1950 | Morrison | 271/225 X |
| 2,665,633 | 1/1954 | Schubert | 271/225 X |
| 2,668,708 | 2/1954 | Back | 271/225 |
| 2,807,463 | 9/1957 | Smith . | |
| 3,552,282 | 1/1971 | Wilson . | |
| 3,584,545 | 6/1971 | Ehlscheid | 493/12 |
| 3,948,510 | 4/1976 | Iwamoto et al. | 493/27 X |
| 3,961,781 | 6/1976 | Funk . | |
| 4,067,171 | 1/1978 | Herbert et al. . | |
| 4,275,879 | 6/1981 | Yamashita et al. | 271/259 |
| 4,310,153 | 1/1982 | Kikuchi | 271/259 |
| 4,547,856 | 10/1985 | Piotroski et al. | 271/259 X |
| 4,616,815 | 10/1986 | Vijuk . | |
| 4,668,211 | 5/1987 | Lubotta et al. . | |
| 4,668,212 | 5/1987 | Kotani | 493/10 X |
| 4,705,496 | 11/1987 | Bay . | |
| 4,804,998 | 2/1989 | Miyawaki | 271/258 X |
| 4,927,133 | 5/1990 | Evans | 271/184 X |

FOREIGN PATENT DOCUMENTS

| | | | |
|---|---|---|---|
| 0055969 | 5/1979 | Japan | 271/259 |

*Primary Examiner*—Bruce M. Kisliuk
*Assistant Examiner*—John A. Marlott
*Attorney, Agent, or Firm*—Killworth, Gottman, Hagan & Schaeff

[57] ABSTRACT

A system and method for automatically producing folded and sealed printed products from form sheets includes a high-speed printer interconnected with a conveyor which directs form sheets from the outfeed of the printer to the infeed of a folder gluer. In an alternative embodiment for producing such products from a form web, the system and method includes a burster interconnected with a conveyor to separate the printed form web into form sheets. Means for controlling the system include jam detection means for sensing and stopping all system components in the event of a form jam. Means for communicating between the printer and conveyor align those elements without need for conventional hard wiring or mechanical fasteners. Means for communicating between the burster and conveyor includes a simple cable and cable connections.

33 Claims, 3 Drawing Sheets

IN-LINE FOLDER/GLUER

BACKGROUND OF THE INVENTION

The present invention relates to an improved system and method for producing sealed printed products, in particular, for automatically printing, conveying, folding and sealing sheet materials for mailing. The present invention further relates to apparatus and control modifications to provide for automatically conveying and controlling printed materials in a folder/gluer.

In the production of folded and sealed printed products, such as mailers, checks, bills and the like, the products are typically printed on individual form sheets or on continuous form webs which are thereafter burst, and the printed form sheets or form webs stacked in a chute. Thereafter, the printed sheets or form webs are manually stacked at the infeed of a folder or folder/-gluer. Wilson, U.S. Pat. No. 3,552,282 shows one such system.

As regards the folding of printed form sheets or form webs, interconnection of printing devices with folders has long been known, shown with respect to mimeograph machines by Smith, U.S. Pat. No. 2,807,463, blueprint machines by Funk, U.S. Pat. No. 3,961,781 and web printing presses by Vijuk, U.S. Pat. No. 4,616,815 and Bay, U.S. Pat. No. 4,705,496. Smith discloses a passive surface on which a mimeographed sheet is sent into a folder, while Funk discloses an inclinable belt conveyor. In the automatic handling of webs, Vijuk requires an intermediate stack to form before the form web is advanced for folding, while Bay inverts the web during transport along a feeding track or channel.

By contrast, the step of manually stacking sheets for folding and gluing typically continues. Lubotta et al, U.S. Pat. No. 4,668,211 discloses schematically, without more, that a printed blank may exit from a laser printer into a conventional folder and gluer.

Forms entering a conventional folder/gluer require proper registration to assure the correct application of adhesives, establishment of fold lines, and alignment of perforations. Such registration is not provided by simple interconnection of known systems. There remains, therefore, a need for development of both systems and means for automatically producing folded and sealed printed products which will automate the production of such products from initial infeed of forms to the final folded and glued product.

SUMMARY OF THE INVENTION

The present invention meets that need by providing a system in which a high-speed printer is interconnected with a folder/gluer to convey, fold and seal form sheets automatically. A conveyor attached at the infeed of the folder/gluer conveys form sheets from the outfeed of the high-speed printer, preferably a laser printer, to the infeed of the folder/gluer. The system further includes means for controlling the operation of the interconnected printer and folder/gluer.

The means for controlling includes first, second and third jam detection sensors located on the conveyor at the end nearest the printer, at the infeed of the folder/-gluer, and at the outfeed of the folder/gluer. The sensors provide signals indicating the passage of forms through the folder/gluer. Means for signalling a form jam, preferably a printed circuit board, receives signals from the first, second and third sensors and generates a control signal to stop the printer, conveyor and folder/-gluer in the event of a jam.

First means for communicating between the printer and conveyor are disposed on the high-speed printer and mate with second means for communicating disposed on the conveyor. The second means for communicating includes at least one docking pin and at least one light source, preferably, a light emitting diode. The first means for communicating includes at least one aperture matable with one of the docking pins, and at least one light sensor, such as a light sensitive transistor or a fiber optic cable attached to such a transistor, aligned with the light source. The light sensor is further connected to means for operating the high-speed printer. At least one of the light sources and light sensors are used to convey control signals to stop the printer in the event a jam is detected in the folder/gluer.

In an alternative embodiment, the high-speed printer is a high-speed laser printer for printing form webs, and includes a burster to separate the form web into individual sheets before discharge onto the conveyor. In the event of a form jam, the control signal also stops the burster. In this embodiment the printer may be connected in line with the burster, or separated so that form webs are manually stacked at the infeed of the burster. Regardless, in the alternative embodiment the burster is positioned between the printer and conveyor, and interfaces with the conveyor.

Further, in the alternative embodiment, a third means for communicating between the burster and conveyor is disposed on the burster. While third means for communicating may be identical to first means for communicating, it is preferred to provide instead only a first cable connection for controlling the burster in the event of a jam. Second means for communicating thus further includes a second cable connection for receiving control signals, and control signals are relayed to the burster by an interface cable interconnected between the first and second cable connections of second and third means for communicating. Where the printer and burster are connected for automatically feeding the form web to the burster, the control signal is further relayed from the burster to stop the printer.

In a further aspect of the present invention, a method is provided for automatically printing, conveying, folding and gluing form sheets into sealed, folded printed products, including steps of sensing for jam detection. Alternatively, the method is adapted for automatic production of sealed, folded printed products from a form web.

It is thus an object of the present invention to provide a completely automatic system for printing, conveying, folding and gluing form sheets and form webs into sealed, folded and printed products.

It is an object of the present invention to provide an automatic system for bursting, conveying, folding and gluing form sheets from a printed form web into sealed, folded and printed products.

It is another object of the present invention to provide a means for controlling wherein all elements of the system may be stopped in the event of a form jam in the folder/gluer.

A further object of the present invention is to provide for interconnection of components with mating means for communicating through which the system components may be aligned and control signals passed without need for conventional connections and hardwiring.

Yet another object of the present invention is to provide a method for automatically printing, conveying, folding and gluing form sheets into sealed, folded and printed products.

DETAILED DESCRIPTION OF THE PREFERRED EMBODIMENT

Figure 1:
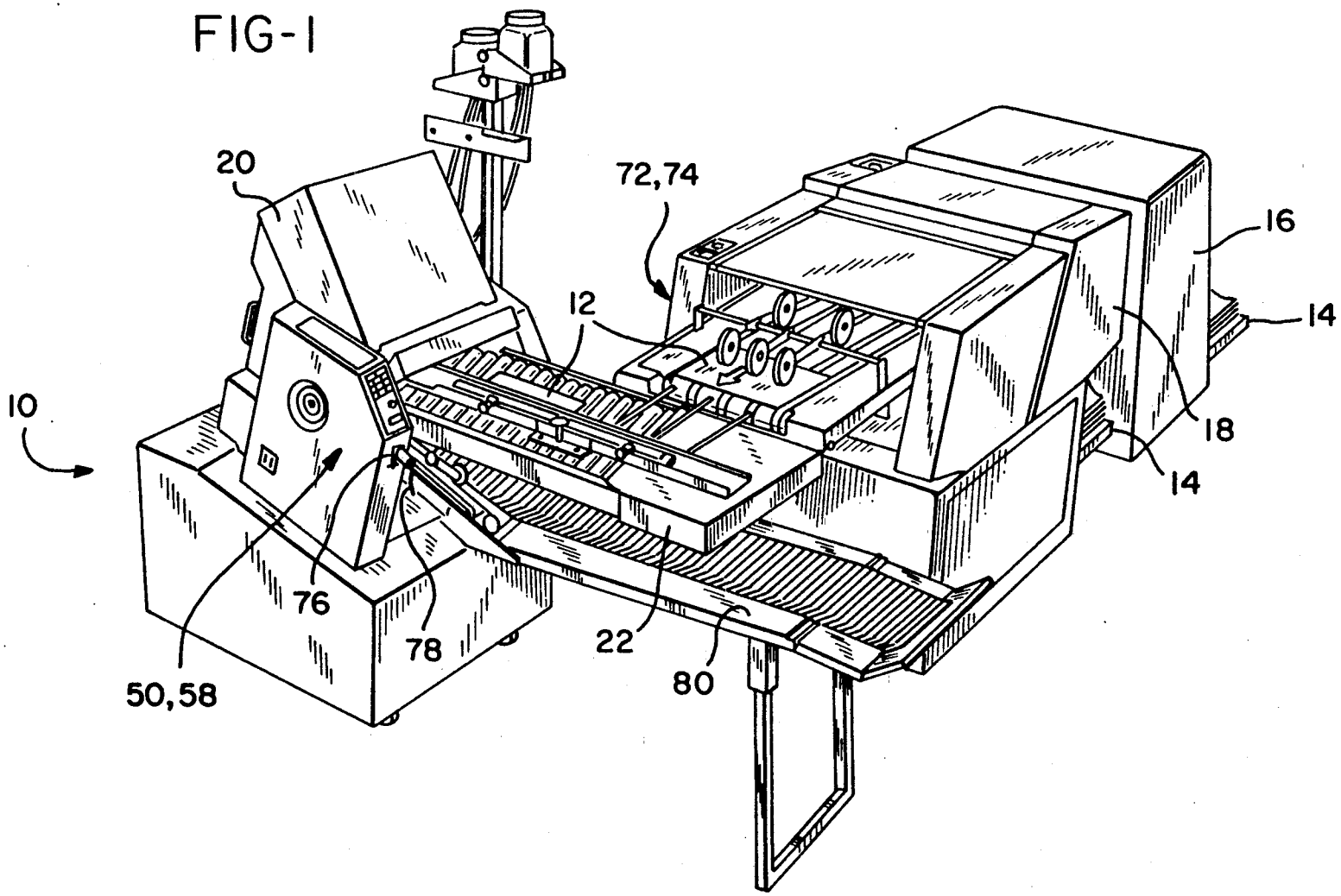
FIG. 1 is a schematic perspective view of the system of the present invention.

Referring to FIG. 1, in accordance with the present invention, a system 10 for automatically printing, conveying, folding and sealing form sheets 12 from form webs 14 is shown. Such a system is particularly suited for preparing mailers, checks, bills and the like, but may also be used in other applications requiring the printing, folding and sealing of form sheets or other sheet materials.

The system 10 of the present invention, as shown in FIG. 1, includes the alternative embodiment of a high-speed printer 16 for printing form webs 14, a burster 18, and a folder/gluer 20. It is understood that the system 10 could include simply a high-speed printer 16' into which form sheets 12 are fed for printing. Shown in FIG. 1, a conveyor 22 attached at the infeed of folder/-gluer 20 conveys printed form sheets 12 from the outfeed of burster 18 to the infeed of folder/gluer 20 for folding and gluing. System 10 further includes means for controlling 50 the operation of the system components.

Printer 16 is a high-speed printer for continuous form webs, preferably a laser printer, such as an IBM 3800 series. Printer 16' is a high-speed printer for form sheets, preferably a laser printer, such as a Xerox 9700 series printer. High-speed printers 16, 16' print at least one side of a form web 14 or form sheet 12, respectively. As shown in FIG. 1, printer 16 is adapted for receiving and printing a form web 14, and is combined with burster 18 which separates form web 14 into individual form sheets 12. Printer 16 may be connected in-line with burster 18 for automatic transfer of printed form web 14 to burster 18 in a manner known in the art, or may be separated so that a printed form web 14 is manually stacked at the infeed of burster 18. Individual form sheets 12 are discharged from burster 18 onto conveyor 22 along a first direction of form movement, as indicated in FIG. 1.

The folding and gluing operations of folder/gluer 20 are conventional, as known in the art, and may be performed on a base unit such as a model 404 folder/gluer manufactured by Baumfolder, Inc., Sidney, Ohio. While the model 404 gluer/folder is a buckle chute folder which performs two folds, any number of folding and gluing apparatuses known in the art may be used. Folder/gluer 20 is capable of operating at or above the maximum output rate of printers 16, 16'.

Figure 2:
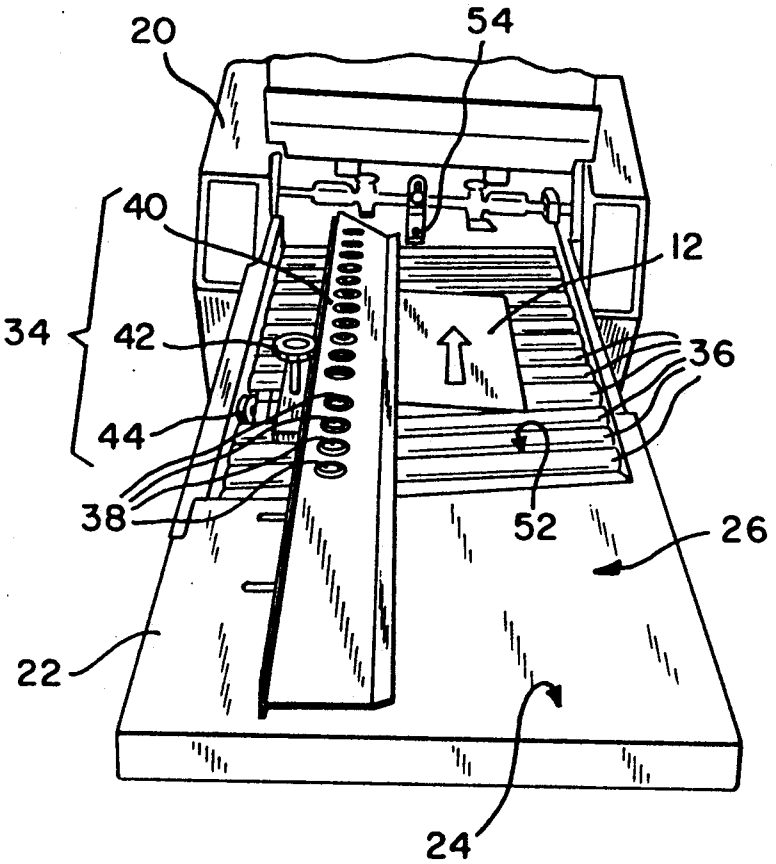
FIG. 2 is a schematic perspective end view of the conveyor and infeed of the folder/gluer in the system of present invention.
Figure 4:
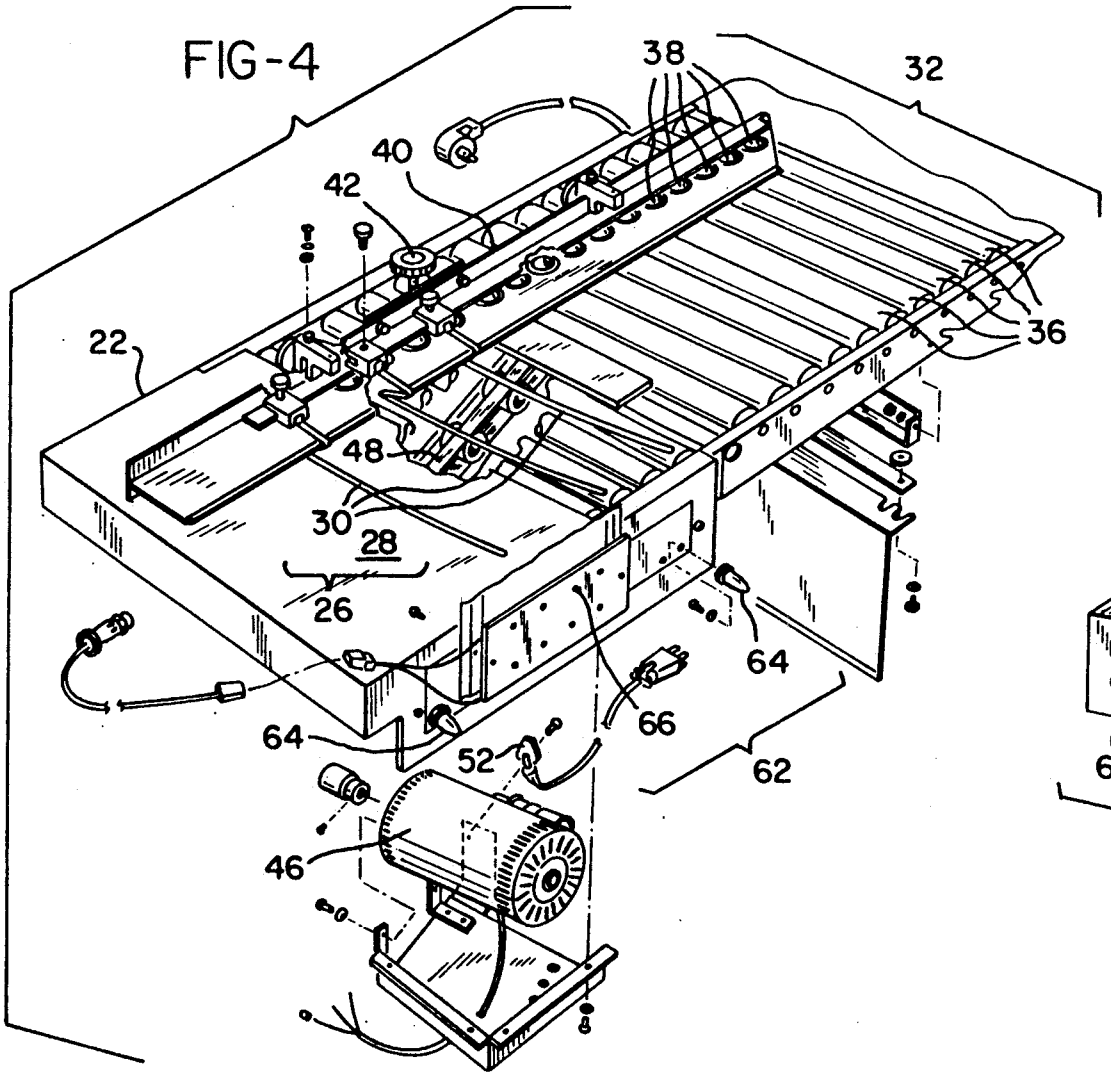
FIG. 4 is an exploded perspective view of the conveyor of FIG. 2, partially cut away to show the means for driving the conveyor rollers, and further showing the second means for communicating between the printer and the conveyor.

Conveyor 22, further shown in FIGS. 2 and 4, receives form sheets 12 on conveyor surface 24 and conveys them in a second direction of form movement towards the infeed of folder/gluer 20 as shown in FIG. 2. As shown in FIGS. 1 and 2, the change in direction aligns the longitudinal axis of form sheets 12 in the second direction of motion, which is preferred for folding. As best shown in FIG. 4, conveyor surface 24 includes means for receiving 26, including a generally flat area 28 on which form sheets 12 may slide and springs 30 which may be adjustably positioned, as shown, to control form sheets 12. Conveyor surface 24 further includes means for advancing 32 and means for aligning 34 form sheets 12.

Means for advancing 32 includes skewed rollers 36 and ball rollers 38. Ball rollers 38 are rotatably kept in fence 40, and are positioned opposite skewed rollers 36. Skewed rollers 36 urge form sheets 12 towards fence 40, and form sheets 12 are nipped between ball rollers 38 and skewed rollers 36 to advance by friction towards the infeed of folder/gluer 20. Heavier or lighter ball rollers 38 may be used to speed or slow the advance of form sheets 12.

Shown in FIGS. 2 and 4, means for aligning 34 comprises fence 40, which may be adjustably positioned across conveyor surface 24 by gross and fine means for adjusting 42 and 44, respectively. Such adjustment permits form sheet 12 to be aligned as desired with respect to perforation knives in folder/gluer 20, or to adapt conveyor 22 to receive and convey form sheets 12 of different sizes. As shown in FIG. 4, skewed rollers 36 are driven by motor 46 and belt 48 in a manner known in the art.

Figure 3:
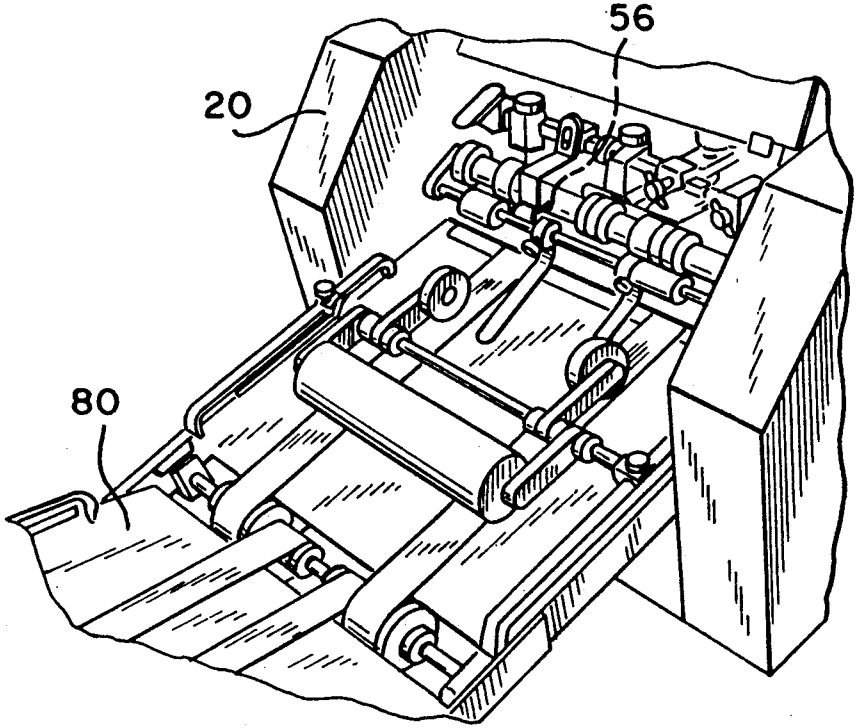
FIG. 3 is a schematic perspective view of the outfeed of the folder/gluer of the present invention.

System 10 further includes means for controlling 50, which includes jam detection means for sensing the travel of a form sheet 12 through folder/gluer 20. Jam detection means includes first, second and third sensors 52, 54 and 56, respectively, positioned at the infeed of conveyor 22 (as shown in FIGS. 2 and 4), at the infeed of folder/gluer 20 (as shown in FIG. 2), and at the outfeed of folder/gluer 20 (as shown in FIG. 3), respectively. Jam detection means further includes means for signalling a form jam, such as circuit means 58, shown in FIG. 1, for receiving signals from sensors 52, 54 and 56 and for signalling system components to stop in the event of a form jam. Each of first, second and third sensors 52, 54 and 56 generate signals to indicate passage of a form sheet 12, and circuit means 58 receives and processes the signals to determine if a form sheet 12 has jammed.

In operation, first sensor 52 determines if a form sheet 12 passes over within a given time. If the form is delayed, first sensor 52 signals circuit means 58 that there is a form jam. Second sensor 54 likewise determines if a form sheet 12 passes over within a given time, and if delayed, second sensor signals circuit means 58 that there is a form jam. Third sensor 56 senses the discharge of a form sheet 12 at the outfeed of folder/gluer 20. Unless third sensor 56 detects the discharge of a folded, sealed form sheet before sensor 54 detects infeed of the next following form sheet 12, circuit means 58 generates a stop signal, indicating a form jam.

In the event of a form jam, circuit means 58 generates a control signal to stop printer 16', or alternatively, burster 18 (and printer 16, if connected), conveyor 22 and folder/gluer 20. First, second and third sensors 52, 54 and 56 are preferably photo-eye proximity sensors, and circuit means 58 is preferably a printed circuit board designed as known in the art to receive and process sensor signals and to generate a stop signal, as needed. Other aspects of means for controlling 50 are conventional, as known in the art.

System 10 further includes first, second and third means for communicating between conveyor 22 and printer 16' or burster 18. High-speed printer 16' includes first means for communicating 60 between printer 16' and conveyor 22. First means for communicating 60 interfaces with second means for communicating 62 which is disposed on conveyor 22. First and second means for communicating 60, 62 align and interconnect printer 16' and conveyor 22, and pass system control signals therebetween without conventional mechanical attachment or hardwiring.

Figure 5:
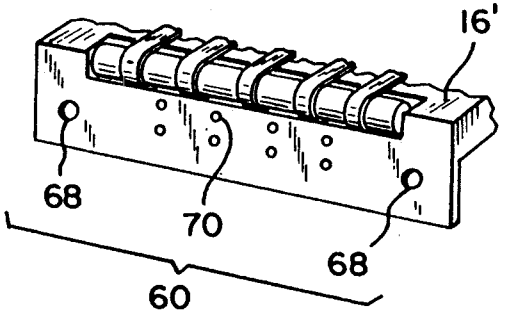
FIG. 5 is a partial perspective view of the first means for communicating between the printer and conveyor disposed on the high speed printer at its interface with the conveyor of the present invention.

As shown in FIG. 4, second means for communicating 62 includes at least one docking pin 64 and at least one light source 66, preferably a light-emitting diode. Shown in FIG. 5, first means for communicating 60 includes at least one aperture 68, preferably with a bushing, matable with docking pin 64, and at least one light sensor 70 aligned with light source 66. Light sensor 70 may be, for example, a light sensitive transistor, fiber optic cable or other arrangement, which is connected to means for operating printer 16'. At least one docking pin 64 and aperture 68 are provided to insure and maintain alignment of light source 66 and light sensor 70. Control signals, such as a stop signal from circuit means 58, may be relayed across the interface between conveyor 22 and printer 16' by light source 66 and light sensor 70.

In the alternative embodiment shown in FIG. 1, a third means for communicating 72 between conveyor 22 and burster 18 is provided at burster 18 to interface with second means for communicating 62. While third means for communicating 72 may be identical to first means for communicating 60, it is preferred for third means for communicating 72 to comprise only a first cable connection 74 to receive control signals to stop burster 18 in the event of a form jam. Second means for communicating 62 thus further includes a second cable connection 76 for sending control signals. Control signals are relayed to burster 18 by interface cable 78 interconnected between first and second cable connections 74, 76. Where printer 16 and burster 18 are connected for automatically feeding form web 14 to burster 18, control signals are further relayed from burster 18 to stop printer 16.

Finally, system 10 may include a conventional stacking device 80 on which sealed and folded printed products are stacked or shingled, as shown in FIG. 1. Materials used to construct the various apparatuses are typical of those known in the art.

In a further aspect of the present invention, a method is provided comprising: providing at least one form sheet 12 to a high-speed printer 16'; printing form sheet 12 on at least one side; discharging form sheet 12 in a first direction of form movement to infeed conveyor 22 of folder/gluer 20; conveying form sheet 12 in a second direction generally 90 degrees to the first direction of form movement; and aligning form sheet 12 for infeed to folder/gluer 20. The method further includes sensing form sheet 12 at the end of conveyor 22 closest to printer 16' with first sensor 52; sensing form sheet 12 at the infeed of folder/gluer 20 with second sensor 54; folding and gluing form sheet 12; and sensing the discharge of form sheet 12 from folder/gluer 20 with a third sensor 56. Finally, the method includes stacking the sealed, folded printed form sheets on a stacking device 80. The steps of sensing the form sheet 12 with the first, second and third sensors 52, 54 and 56 include signalling passage of the form sheet 12 to a means for signalling a form jam, circuit means 58, which in the event of a form jam, further triggers the step of signalling high-speed printer 16', conveyor 22 and folder/gluer 20 to stop.

Alternatively, the method eliminates printer 16' and begins with the step of providing a printed form web 14 to the infeed of burster 18; and bursting an individual form sheet 12 from form web 14. Additionally, those steps may be preceded by the steps of providing a form web 14 to printer 16; printing form web 14 on at least one side; and conveying form web 14 to the infeed of burster 18. These steps occur before the step of discharging form sheet 12 to infeed conveyor 22.

While certain representative embodiments and details have been shown for purposes of illustrating the invention, it will be apparent to those skilled in the art that various changes in the apparatus, method and article disclosed herein may be made without departing form the scope of the invention, which is defined in the appended claims.

What is claimed is:

1. A continuous, automatic system for producing folded and sealed printed products comprising:

printer means for high-speed printing of forms;

folder/gluer means for folding and gluing forms conveyed from said printer means into folded, sealed products;

said folder/gluer means further comprising means for conveying forms between the outfeed of said printer means to the infeed of said folder/gluer means, said means for conveying adapted for high speed conveyance of forms and further including:

means for receiving forms outfeed from said printer means;

means for advancing said forms from said means for receiving to the infeed of said folder/gluer means at an angle to the direction of outfeed of said forms from said printer means; and means for aligning said forms on said means for advancing for infeed to said folder/gluer means, said means for aligning contacting the leading edge of said forms conveyed from said printer means, such that another edge of said forms becomes the leading edge of said forms and is advanced to the infeed of said folder/gluer;

matable first and second means for communicating between said printer means and said folder/gluer means, said first means for communicating disposed on and connected to said printer means and mating with said second means for communicating disposed on said means for conveying and connected to said folder/gluer means; and means for controlling the operation of said printer means and said folder/gluer means.

2. A system as recited in claim 1 wherein said printer means comprises a laser printer.

3. A system as recited in claim 1 further comprising means for stacking.

4. A system as recited in claim 1 wherein:

said means for controlling further comprises jam detection means for sensing the travel of a form through said folder/gluer means and for signalling a form jam; and said first and second means for communicating comprise means for relaying control signals from said jam detection means to said printer means.

5. A system as recited in claim 4 wherein said jam detection means comprises:

a first sensor disposed at the end of said conveyor nearest said printer means;

a second sensor disposed at the infeed of said folder/-gluer means for sensing and signalling the entry of a form into said folder/gluer means;

a third sensor disposed at the outfeed of said folder/-gluer means for sensing and signalling the exit of a form from said folder/gluer means; and circuit means for receiving signals from said first, second and third sensors and for signalling a form jam, said circuit means adapted to signal a form jam by generating a control signal to stop said folder/-gluer means, said means for conveying, and said printer means.

6. A system as recited in claim 5 wherein at least one of said first, second and third sensors comprises a photodetector.

7. A system as recited in claim 5 wherein at least one of said first, second and third sensors comprises a proximity sensor.

8. A system as recited in claim 5 wherein said circuit means comprises a printed circuit board.

9. A system as recited in claim 1 wherein said printer means comprises a laser printer for printing a continuous form web, and said system further comprises:

a burster for producing individual form sheets from a form web, said burster situated between said laser printer and said means for conveying to receive a form web from said laser printer and discharge form sheets to said means for conveying.

10. A system as recited in claim 9 wherein said burster further includes third means for communicating between said burster and said means for conveying.

11. A system as recited in claim 10 wherein said third means for communicating comprises a first cable connection and an interface cable connectable thereto, and said folder/gluer means further comprises a second cable connection adapted for connecting to said interface cable.

12. A continuous, automatic system for producing folded and sealed printed products comprising:

printer means for high-speed printing of forms;

folder/gluer means for folding and gluing forms conveyed from said printer means into folded, sealed products;

said folder/gluer means further comprising means for conveying forms between the outfeed of said printer means to the infeed of said folder/gluer means, said means for conveying adapted for high speed conveyance of forms and further including:

means for receiving forms outfeed from said printer means;

means for advancing said forms from said means for receiving to the infeed of said folder/gluer means at an angle to the direction of outfeed of said forms from said printer means; and means for aligning said forms on said means for advancing for infeed to said folder/gluer means;

matable first and second means for communicating between said printer means and said folder/gluer means, said first means for communicating disposed on and connected to said printer means and mating with said second means for communicating disposed on said means for conveying and connected to said folder/gluer means;

means for controlling the operation of said printer means and said folder/gluer means, said means for controlling further comprising means for sensing the travel of a form through said folder/gluer means and for signalling a form jam; and said first and second means for communicating further comprising means for relaying control signals from said jam detection means to said printer means, said means for relaying comprising at least one light source in said second means for communicating and at least one mating light sensor disposed in said first means for communicating, said light sensor connected to means for operating said printer means.

13. A system as recited in claim 12 wherein said light source comprises a light emitting diode.

14. A system as recited in claim 12 wherein said light sensor comprises a light sensitive transistor.

15. A continuous, automatic system for producing sealed printed products from a form web comprising:

a bursting apparatus for separating a form web into individual form sheets;

a folder/gluer for folding and gluing form sheets conveyed from said bursting apparatus into folded, sealed products;

said folder/gluer further comprising a conveyor for conveying form sheets between the outfeed of said bursting apparatus to the infeed of said folder/-gluer, said conveyer adapted for high speed conveyance of forms, and further including;

means for receiving forms sheets outfeed from said bursting apparatus;

means for advancing said form sheets from said means for receiving to the infeed of said folder/-gluer means at an angle to the direction of outfeed of said form sheets from said bursting apparatus; and means for aligning said form sheets on said means for advancing for infeed to said folder/gluer;

matable first and second means for communicating between said bursting apparatus and said folder/-gluer, said second means for communicating connected to said folder/gluer and disposed on said conveyor for mating with said first means for communicating disposed on and connected to said bursting apparatus; and means for controlling the operation of said bursting apparatus, conveyor and folder/gluer.

16. A system as recited in claim 15 wherein said first means for communicating comprises a first cable connection and an interface cable connectable thereto, and said second means for communicating comprises a second cable connection adapted for connecting to said interface cable.

17. A system as recited in claim 15 further comprising printer means for high-speed printing on a form web.

18. A system as recited in claim 15 wherein said means for receiving comprises:

a substantially flat plate defining an area in which said form sheets may be slidably received; and one or more leaf springs adjustably positionable along one edge of said area to control said form sheets arriving thereon.

19. A system as recited in claim 15 wherein said means for advancing comprises:

a plurality of skewed rollers rotatably driven and oriented to urge said form sheets against said means for aligning, said skewed rollers; and a plurality of ball rollers rotatably disposed along said means for aligning, ones of said ball rollers positioned opposite ones of said skewed rollers to provide a nip between which said form sheets may be frictionally engaged and advanced.

20. A system as recited in claim 15 wherein said means for aligning comprises:

a fence extending from the infeed of said folder/gluer means substantially along the length of said means for advancing and said means for receiving, and adjustably positionable laterally thereacross, said fence adapted for contact with said form sheets on said means for receiving and said means for advancing; and means for adjusting the position of said fence laterally across said means for advancing and said means for receiving.

21. A system as recited in claim 15 wherein said means for aligning contacts the leading edge of said form sheets conveyed from said bursting apparatus, such that another edge of said form sheets becomes the leading edge of said form sheets and is advanced to the infeed of said folder/gluer.

22. A method for automatically producing sealed and folded printed forms comprising the steps of:

providing at least one form sheet to a high-speed printer;

printing said form sheet on at least one side with said high-speed printer;

discharging said form sheet from said high-speed printer in a first direction of form movement onto an infeed conveyor of a folder/gluer;

conveying said form sheet on said conveyor in a second direction at an angle to said first direction of form movement, said step of conveying performed at a high speed substantially the same as or greater than the speed at which said form sheet is discharged from said high-speed printer, said step of conveying further comprising the step of changing the leading edge of said form sheet received from said high-speed printer to a different edge;

aligning said form sheet on said conveyor for infeed to said folder/gluer;

sensing the presence of said form sheet at the infeed of said folder/gluer with a first sensor;

initiating the folding and gluing of said form sheet;

sensing the position of said form sheet generally midway between said infeed and the outfeed of said folder/gluer with a second sensor;

completing the folding and gluing of said form sheet;

discharging said form sheet at said outfeed of said folder/gluer; and sensing said form sheet at a third sensor.

23. A method as recited in claim 22 further including the step of stacking said folded and sealed printed form sheet on a stacking device.

24. A method as recited in claim 22 wherein the steps of sensing said form sheet with said first, second and third sensors include signalling the presence of said form sheet to a means for signalling a form jam.

25. A method for automatically producing sealed and folded printed forms from a form web comprising the steps of:

providing said form web to a burster;

separating said form web into individual form sheets;

discharging said form sheets from said burster in a first direction of form movement onto an infeed conveyor of a folder/gluer;

conveying said form sheets on said conveyor in a second direction at an angle to said first direction of form movement, said step of conveying performed at a high speed substantially the same as or greater than the speed at which said form sheet is discharged from said burster, said step of conveying further comprising the step of changing the leading edge of said form sheet received from said burster to a different edge;

aligning said form sheet on said conveyor for infeed to said folder/gluer;

sensing the presence of said form sheet at the infeed of said folder/gluer with a first sensor;

initiating the folding and gluing of said form sheet;

sensing the position of said form sheet generally midway between said infeed and the outfeed of said folder/gluer with a second sensor;

completing the folding and gluing of said form sheet;

discharging said form sheet at said outfeed of said folder/gluer; and sensing said form sheet at a third sensor.

26. A method as recited in claim 25 further including the step of stacking said folded and sealed printed form sheet on a stacking device.

27. A method as recited in claim 25 wherein the steps of sensing said form sheet with said first, second and third sensors include signalling the presence of said form sheet to a means for signalling a form jam.

28. A method as recited in claim 25 further including, as the first steps thereof:

providing a form web to a high-speed printer;

printing said form web on at least one side with said high-speed printer.

29. A continuous, automatic system for producing folded and sealed printed products comprising:

printer means for high-speed printing of forms;

folder/gluer means for folding and gluing forms conveyed from said printer means into folded, sealed products;

said folder/gluer means further comprising means for conveying forms between the outfeed of said printer means to the infeed of said folder/gluer means, said means for conveying adapted for high speed conveyance of forms and further including:

means for receiving forms outfeed from said printer means;

means for advancing said forms from said means for receiving to the infeed of said folder/gluer means at an angle to the direction of outfeed of said forms from said printer means; and means for aligning said forms on said means for advancing for infeed to said folder/gluer means;

matable first and second means for communicating between said printer means and said folder/gluer means, said first means for communicating disposed on and connected to said printer means and mating with said second means for communicating disposed on said means for conveying and connected to said folder/gluer means, said second means for communicating comprising one or more docking pins and said first means for communicating comprising one or more mating apertures; and means for controlling the operation of said printer means and said folder/gluer means, said means for controlling further comprising means for sensing the travel of a form through said folder/gluer means and for signalling a form jam; and said first and second means for communicating further comprising means for relaying control signals from said jam detection means to said printer means.

30. A continuous, automatic system for producing folded and sealed printed products comprising:

printer means for high-speed printing of forms;

folder/gluer means for folding and gluing forms conveyed from said printer means into folded, sealed products;

said folder/gluer means further comprising means for conveying forms between the outfeed of said printer means to the infeed of said folder/gluer means, said means for conveying adapted for high speed conveyance of forms and further including:

means for receiving forms outfeed from said printer means, said means for receiving comprising:

a substantially flat plate defining an area in which said forms may be slidably received; and one or more leaf springs adjustably positionable along one edge of said area to control said forms arriving thereon;

means for advancing said forms from said means for receiving to the infeed of said folder/gluer means at an angle to the direction of outfeed of said forms from said printer means; and means for aligning said forms on said means for advancing for infeed to said folder/gluer means;

matable first and second means for communicating between said printer means and said folder/gluer means, said first means for communicating disposed on and connected to said printer means and mating with said second means for communicating disposed on said means for conveying and connected to said folder/gluer means; and means for controlling the operation of said printer means and said folder/gluer means.

31. A continuous, automatic system for producing folded and sealed printed products comprising:

printer means for high-speed printing of forms;

folder/gluer means for folding and gluing forms conveyed from said printer means into folded, sealed products;

said folder/gluer means further comprising means for conveying forms between the outfeed of said printer means to the infeed of said folder/gluer means, said means for conveying adapted for high speed conveyance of forms and further including:

means for receiving forms outfeed from said printer means;

means for advancing said forms from said means for receiving to the infeed of said folder/gluer means at an angle to the direction of outfeed of said forms from said printer means, said means for advancing comprising:

a plurality of skewed rollers rotatably driven and oriented to urge said forms against said means for aligning, said skewed rollers; and a plurality of ball rollers rotatably disposed along said means for aligning, ones of said ball rollers positioned opposite ones of said skewed rollers to provide a nip between which said forms may be frictionally engaged and advanced; and means for aligning said forms on said means for advancing for infeed to said folder/gluer means;

matable first and second means for communicating between said printer means and said folder/gluer means, said first means for communicating dispsoed on and connected to said printer means and mating with said second means for communicating disposed on said means for conveying and connected to said folder/gluer means; and means for controlling the operation of said printer means and said folder/gluer means.

32. A continuous, automatic system for producing folded and sealed printed products comprising:

printer means for high-speed printing of forms;

folder/gluer means for folding and gluing forms conveyed from said printer means into folded, sealed products;

said folder/gluer means further comprising means for conveying forms between the outfeed of said printer means to the infeed of said folder/gluer means, said means for conveying adapted for high speed conveyance of forms and further including:

means for receiving forms outfeed from said printer means;

means for advancing said forms from said means for receiving to the infeed of said folder/gluer means at an angle to the direction of outfeed of said forms from said printer means; and means for aligning said forms on said means for advancing for infeed to said folder/gluer means, said means for aligning comprising:

a fence extending from the infeed of said folder/gluer means substantially along the length of said means for advancing and means for receiving, said fence adjustably positionable laterally thereacross, and said fence adapted for contact with forms on said means for receiving and said means for advancing; and means for adjusting the position of said fence laterally across said means for advancing and said means for receiving;

matable first and second means for communicating between said printer means and said folder/gluer means, said first means for communicating disposed on and connected to said printer means and mating with said second means for communicating disposed on said means for conveying and connected to said folder/gluer means; and means for controlling the operation of said printer means and said folder/gluer means.

33. A continuous, automatic system for producing sealed printed produced from a form web comprising:

a bursting apparatus for separating a form web into individual form sheets;

a folder/gluer for folding and gluing forms sheets conveyed from said bursting apparatus into folded, sealed products;

said folder/gluer further comprising a conveyor for conveying form sheets between the outfeed of said bursting apparatus to the infeed of said folder/gluer, said conveyor adapted for high speed conveyance of forms, and further including;

means for receiving form sheets outfeed from said bursting apparatus, said means for receiving comprising:

a substantially flat plate defining an area in which said form sheets may be slidably received; and one or more leaf springs adjustably positionable along one edge of said area to control said form sheets arriving thereon;

means for advancing said form sheets from said means for receiving to the infeed of said folder/-gluer means at an angle to the direction of outfeed of said form sheets from said bursting apparatus, said means for advancing comprising:

a plurality of skewed rollers rotatably driven and oriented to urge said form sheets against said means for aligning, said skewed rollers; and a plurality of ball rollers rotatably disposed along said means for aligning, ones of said ball rollers positioned opposite ones of said skewed rollers to provide a nip between which said form sheets may be frictionally engaged and advanced; and means for aligning said form sheets on said means for advancing for infeed to said folder/gluer, said means for aligning comprising:

a fence extending from the infeed of said folder/-gluer means substantially along the length of said means for advancing and said means for receiving, and adjustably positionable laterally thereacross, said fence adapted for contact with said form sheets on said means for receiving and said means for advancing; and means for adjusting the position of said fence laterally across said means for advancing and said means for receiving;

matable first and second means for communicating between said bursting apparatus and said folder/-gluer, said second means for communicating connected to said folder/gluer and disposed on said conveyor for intermating with said first means for communicating disposed on and connected to said bursting apparatus; and means for controlling the operation of said bursting apparatus, conveyor and folder/gluer.

* * * * *